US009656775B2

(12) United States Patent
Nyckowski et al.

(10) Patent No.: US 9,656,775 B2
(45) Date of Patent: May 23, 2017

(54) STRAP-LESS BALING METHOD AND BALER

(71) Applicant: Illinois Tool Works Inc., Glenview, IL (US)

(72) Inventors: Andrew J. Nyckowski, Palatine, IL (US); James A. Haberstroh, Vernon Hills, IL (US); Timothy B. Pearson, Antioch, IL (US)

(73) Assignee: SIGNODE INDUSTRIAL GROUP LLC, Glenview, IL (US)

( * ) Notice: Subject to any disclaimer, the term of this patent is extended or adjusted under 35 U.S.C. 154(b) by 947 days.

(21) Appl. No.: 13/840,601

(22) Filed: Mar. 15, 2013

(65) Prior Publication Data

US 2013/0305662 A1 Nov. 21, 2013

Related U.S. Application Data

(60) Provisional application No. 61/716,958, filed on Oct. 22, 2012, provisional application No. 61/647,823, filed on May 16, 2012.

(51) Int. Cl.

| | |
|---|---|
| ***B65B 63/02*** | (2006.01) |
| ***B30B 9/30*** | (2006.01) |
| ***B30B 15/32*** | (2006.01) |
| ***B65B 27/12*** | (2006.01) |

(52) U.S. Cl.

CPC ..... *B65B 63/022* (2013.01); *B30B 9/3014* (2013.01); *B30B 15/32* (2013.01); *B65B 27/125* (2013.01); *B65B 63/02* (2013.01)

(58) Field of Classification Search

CPC ..... B65B 63/022; B65B 63/02; B65B 27/125; B65B 5/045; B65B 13/20; B30B 9/3014; B30B 15/32; B65G 2818/026; B65G 47/252

USPC ..... 198/403; 100/95

See application file for complete search history.

(56) References Cited

U.S. PATENT DOCUMENTS

| | | | | |
|---|---|---|---|---|
| 3,968,619 A | | 7/1976 | Fishburne | |
| 4,162,603 A | | 7/1979 | Stromberg | |
| 5,694,742 A | * | 12/1997 | Elliott | B30B 9/301 100/218 |

(Continued)

FOREIGN PATENT DOCUMENTS

| | | |
|---|---|---|
| AU | 4851768 A | 7/1971 |
| AU | 310432 | 10/2006 |

(Continued)

OTHER PUBLICATIONS

Examination Report for AU 201326744 dated Sep. 15, 2015.

International Search Report for PCT/US2013/041289, dated Aug. 14, 2013.

International Search Report for PCT/US2015/012900, dated Mar. 23, 2015.

*Primary Examiner* — Robert Long

*Assistant Examiner* — Xavier A Madison

(74) *Attorney, Agent, or Firm* — Levenfeld Pearlstein, LLC

(57) ABSTRACT

A method for containing a bale of compressible material without straps or wires includes compressing a quantity of compressible material into a bale and introducing the bale of compressed material into a container in the compressed state. The container can be sealed following receipt of the bale. A baler can be used with a press for compressing the material, and a bagging station can facilitate transfer of the bale to the container without straps or wires securing the bale following compression.

15 Claims, 10 Drawing Sheets

(56) References Cited

U.S. PATENT DOCUMENTS

| | | | | |
|---|---|---|---|---|
| 5,743,374 | A * | 4/1998 | Monsees | B65G 57/08 198/403 |
| 5,890,426 | A | 4/1999 | Gumkowski | |
| 7,013,625 | B2 | 3/2006 | Curles | |
| 7,389,723 | B1 | 6/2008 | Bullington | |
| 7,421,944 | B1 | 9/2008 | Flaum et al. | |
| 7,958,699 | B2 | 6/2011 | Honegger | |
| 7,987,651 | B2 | 8/2011 | Beeland | |
| 2005/0284775 | A1 | 12/2005 | McLaughlin | |
| 2010/0146908 | A1* | 6/2010 | Honegger | B65B 9/073 53/439 |
| 2011/0094396 | A1 | 4/2011 | Borrelli et al. | |
| 2013/0305662 | A1 | 11/2013 | Nyckowski | |
| 2014/0041339 | A1 | 2/2014 | Borrelli | |

FOREIGN PATENT DOCUMENTS

| | | | |
|---|---|---|---|
| CN | 1527778 | A | 9/2004 |
| CN | 2764602 | Y | 3/2006 |
| CN | 1290745 | C | 12/2006 |
| DE | 3009016 | A1 | 9/1981 |
| EP | 0198992 | A1 | 10/1986 |
| EP | 0928555 | A1 | 7/1999 |
| WO | 9420366 | A1 | 9/1994 |
| WO | 2006115973 | A1 | 11/2006 |
| WO | 2007028558 | A1 | 3/2007 |
| WO | 2008040090 | A1 | 4/2008 |
| WO | 2009115314 | A1 | 9/2009 |

* cited by examiner

STRAP-LESS BALING METHOD AND BALER

BACKGROUND

Large quantities of low density fibrous materials such as cotton and the like are often bundled or baled for handling and storage. In a typical process, cotton is cleaned to separate the cotton fibers from and sticks and other debris, and the cotton fibers are separated from the seed in a gin. The cotton (referred to as lint) is transported to a press or baler where it is compressed into a high density bundle or bale.

Following compaction, the bale is secured to facilitate handling. The bale can be secured by multiple straps or wires to maintain the bale configuration and stability. One industry standard is to band the bale with eight (8) wires or straps around the shorter periphery of the bale.

Typically, the bale is then sampled and classed into a standard cotton class to identify the quality of the cotton. The bale is then wrapped for protection, for example, in a wrap or bag, to protect the cotton from exposure to the environs, dirt, debris or factors that can affect the cotton quality. Wrapping or bag materials include polyethylene, polypropylene, cotton and the like. The wrapped bale can then be transported for subsequent processing.

In a typical cotton baler or press, the lint is fed into a press in which it is pressed or compacted in a high pressure compactor or press. In one system, the compressed bale is then transported to a separate strapping machine. In order to move or convey the compressed bales, the press includes grooves or guides into which tines of a fork truck are inserted. Due to shifting of the load during compaction, the tines must be manually adjusted to assure proper alignment. Moreover, due to the high pressure that is applied during compaction, it may also be necessary to apply pressure in multiple stages so as to offset load shifting which further exaggerates manual tine alignment.

Alternately, the press can be formed as part of or integral with the strapping machine. Such machines are disclosed in Bullington, U.S. Pat. No. 7,389,723 and Flaum, U.S. Pat. No. 7,421,944, both of which are commonly assigned with the present application and are incorporated herein by reference.

While such machines function well, the nevertheless require the use of straps or wires to maintain the bale in its compacted state. In addition, a separate wrapping or bagging device and downstream process are needed to provide the protective overwrap for the bale.

Accordingly, there is a need for a method and device for strap-less or wire-less baling. Such a method provides for compaction and containment of a strap-less or wire-less bale. A device or machine for strap-less baling applies a high level of compaction in an automated system in a single compaction cycle. Desirably, such a machine compacts and packages, e.g., bags, the compacted bales without the use of straps or wires to maintain the bale in a baled state and without loosening of the baled material.

SUMMARY

A method for containing a bale of compressible material without straps or wires includes, generally, receiving a quantity of compressed material, compressing the material into a bale and introducing the bale of compressed material, without straps or wires, into a container, such as a bag, in the compressed state. The bale transferred, once compressed, in a transfer direction and can be introduced into the container in a containerizing or bagging direction.

The method can include sealing the container after the bale is positioned within the container. The bale can be compressed into a shape, and the container can have a shape about the same as that of the compressed bale. The transfer direction and containerizing (or bagging) directions can be transverse to one another.

One exemplary device or machine for carrying out the strap-less baling is a strap-less baler that is used with a press for compressible materials, such as cotton and the like. It is contemplated that a high pressure press is used with the baler.

Such a baler includes generally a frame, a conveyor, a bagging station or bagger and a controller. The conveyor includes a mobile portion and a load carriage. The load carriage includes a region for receiving a bale from the press.

In an embodiment, the load carriage is pivotally mounted to the mobile portion to reorient the bale from receipt at the press to transfer to the bagger. The load carriage can be mounted to the mobile portion by a pivot shaft and supported or balanced by springs to facilitate alignment and engagement with the press.

The load carriage includes a plurality of fork sets mounted for rotation about a common axis to reorient the bale. A pusher, such as a transfer plate, can be mounted within the fork sets to facilitate pushing the bale from the fork sets. The load carriage moves along a track between the press and the bagger.

The bagger includes a chute having an entrance and a discharge. The discharge has a bagging mandrel. The bagger is configured to receive a bale and move the bale from the entrance to the discharge and the bagging mandrel.

A transfer station facilitates transfer of the bale from the load carriage to the bagger. The transfer station includes a drive, such as one or more reciprocating cylinders. A support element can be mounted to the transfer plate that cooperates with a transfer drive to facilitate transfer of the bale to the bagger. The transfer drive can be one or more reciprocating cylinders.

The bagger entrance is located on a side of the bagger. The discharge is transverse to the entrance. The bagger can include guides in which the fork sets are received when transferring the bale to the bagger. The bagger includes a bag mandrel at the discharge.

A back-up assembly may be positioned on the bagger. The back-up assembly includes a movable wall disposed at a side of the bagger opposite the entrance and a drive, such as one or more reciprocating cylinders to move the wall toward and away from the entrance.

The load carriage is configured to receive the bale in an orientation and pivot to reorient the bale about 180 degrees to transfer the bale to the bagger entrance. The bale is introduced into the bagger without straps or wires on the bale.

A method for bagging a bale of compressible material without straps or wires, using such a baler, includes the steps of receiving from a press in a first orientation, a bale of compressed material in a conveyor having a mobile portion and a load carriage. The bale is reoriented to a second orientation and is conveyed to the bagger. The bale is then transferred to the bagger in a transfer direction. The method can include the step of discharging the bale from the bagger into a bag in bagging direction. Following receipt of the bale in the bag, the bag can be sealed.

In one method, the reorienting step includes rotating the bale about 180 degrees from the first orientation to the second orientation. The method can further include actuating a transfer assembly and pushing the bale from the load carriage into the bagger.

The container or bag can provide structure to bale, e.g., maintain a shape and size, and can provide protection for the bale. Such a bag can be formed from a polymeric or polymer coated material and can be reinforced, with, for example, internal straps or stays, to maintain the general size and shape of the bale. The polymeric material and/or coating can provide protection from the elements, dirt, debris and the like.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

A method for containing a bale of compressible material without straps or wires includes, generally, receiving a quantity of compressed material, compressing the material into a bale and introducing the bale of compressed material, without straps or wires, into a container, such as a bag, in the compressed state. Such a method is contemplated for use with, for example, cotton lint which has been cleaned and separated for subsequent sampling and processing.

The method can include compressing the bale at a location (a compressing location) and transferring the compressed bale, in a transfer direction to a different location (a bagging or containerizing) location for bagging. In transferring the bale from the compression location to the bagging location the bale van be retained in the compressed state. Bagging or containerizing may be carried out in a different direction (a bagging or containerizing direction) different from (e.g., transverse to) the transfer direction.

The method can include sealing the container after the bale is positioned within the container. The bale can be compressed into a shape, and the container can have a shape about the same as that of the compressed bale. The container can be, for example, a high strength bag. Such bags can be formed from a polymer, such as polypropylene, polyethylene or the like. Other materials will be recognized by those skilled in the art.

The bag can include strengthening or stabilizing members, such as straps or stiffeners internally, externally or formed as part of the bag (e.g., molded with the bag) to provide stability to the compressed and packaged bale. The bag can then be closed or sealed to form a packaged bale for subsequent handling.

Figure 1:
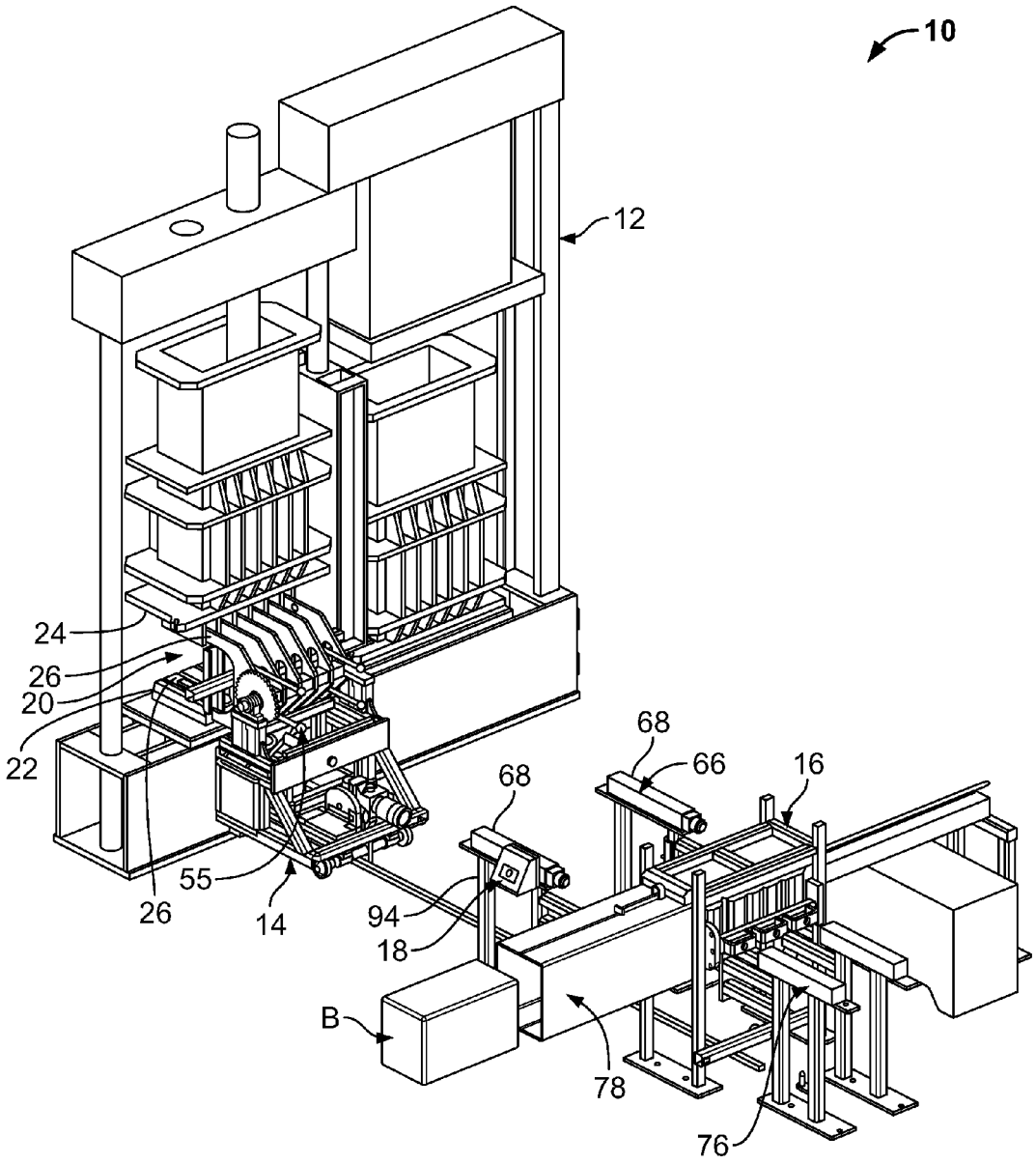
FIG. 1 is a perspective illustration of a strap-less bagger shown with a compressible material press.
Figure 2:
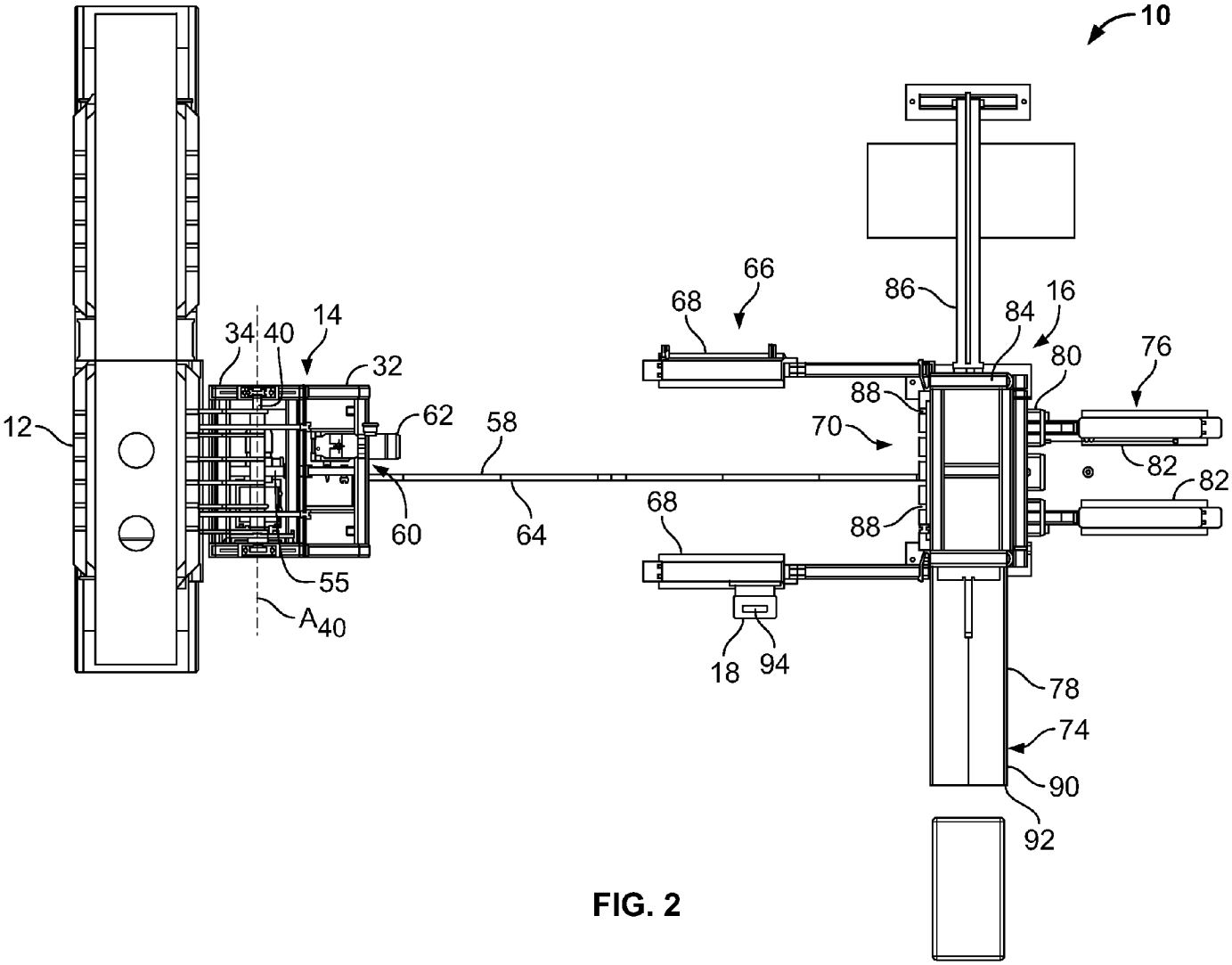
FIG. 2 is a top view of the bagger and press of FIG. 1.
Figure 3:
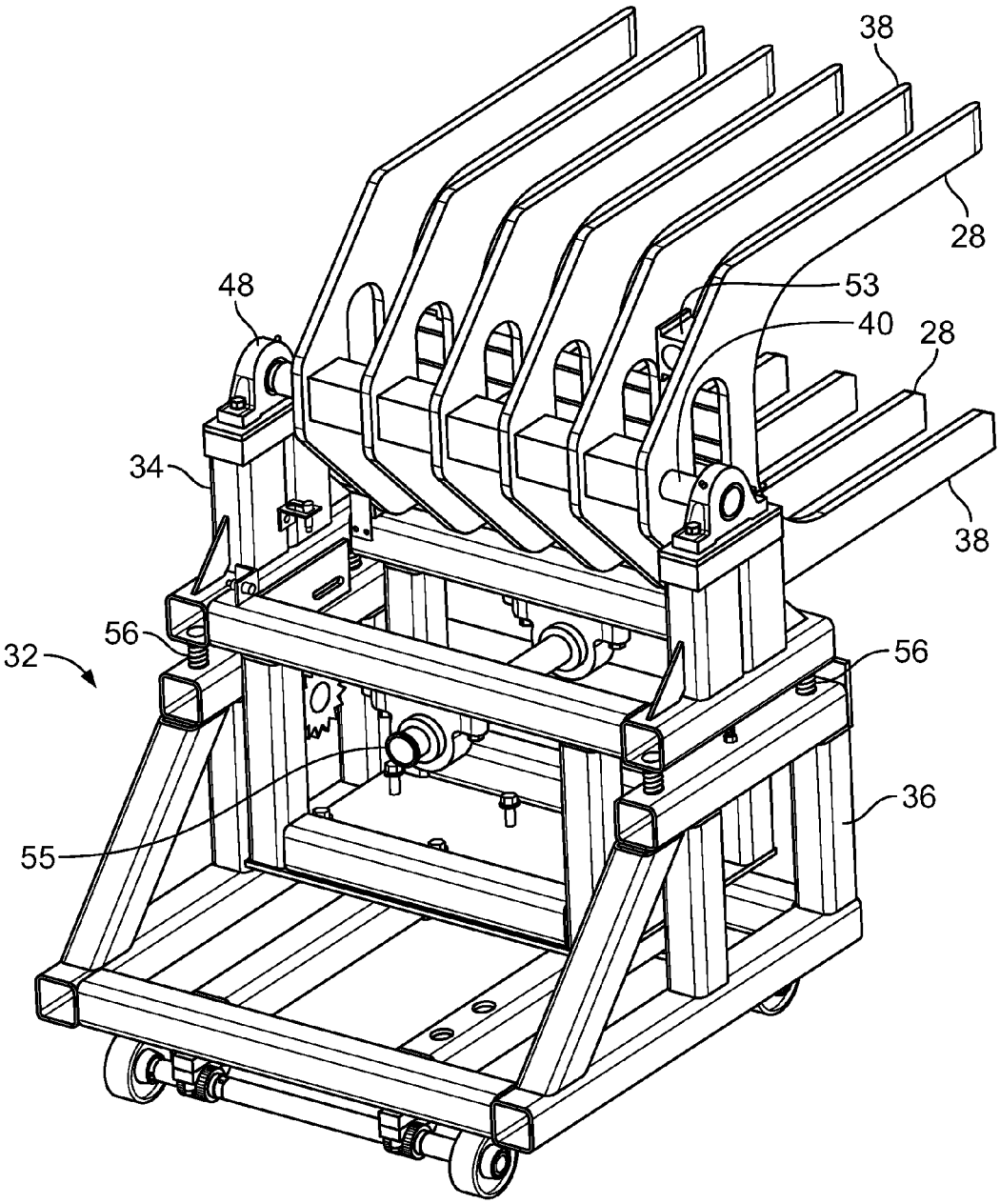
FIG. 3 is a perspective view of the conveyor load carriage and mobile base.
Figure 4:
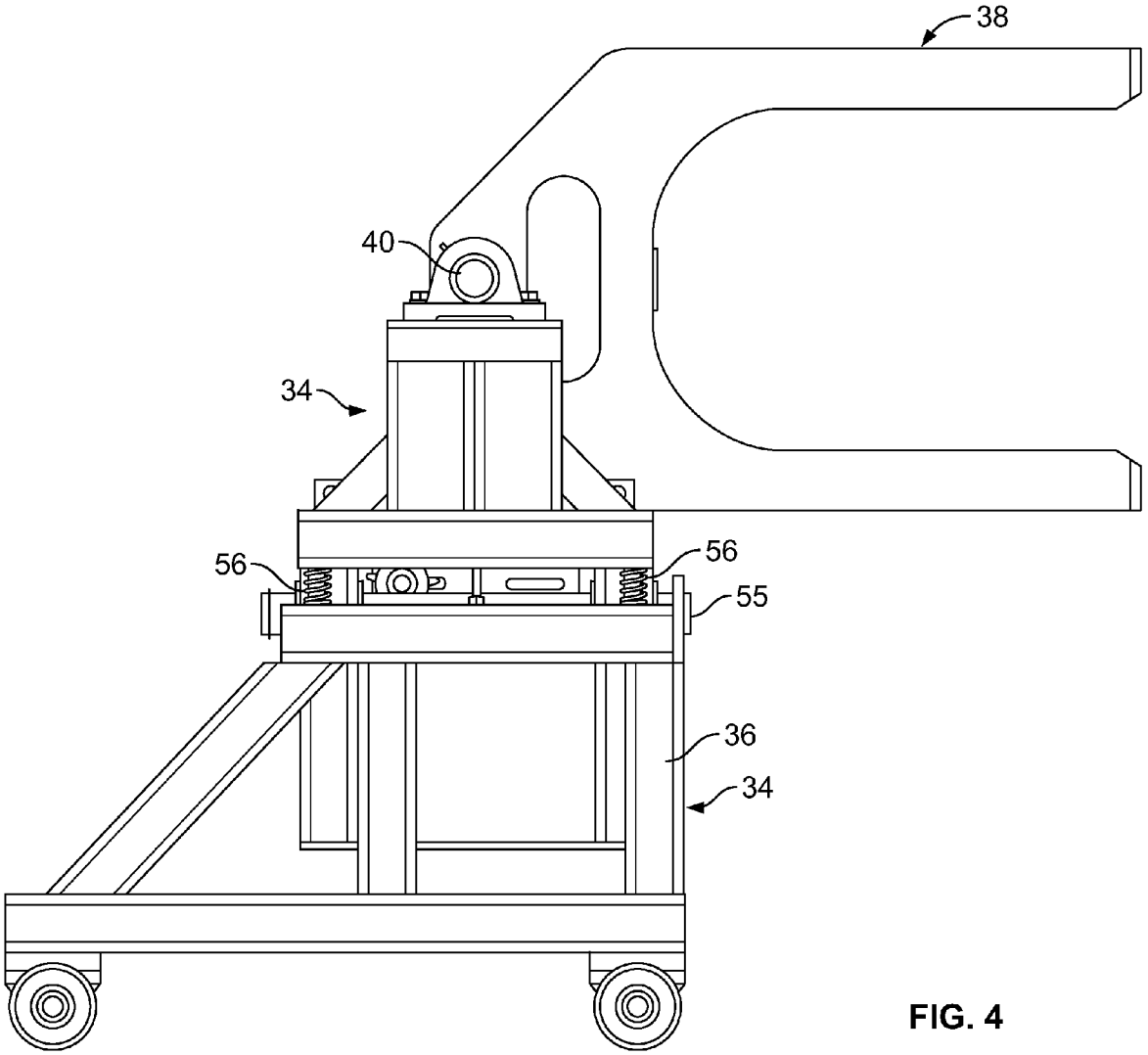
FIG. 4 is a front view of the conveyor load carriage and mobile base.
Figure 5:
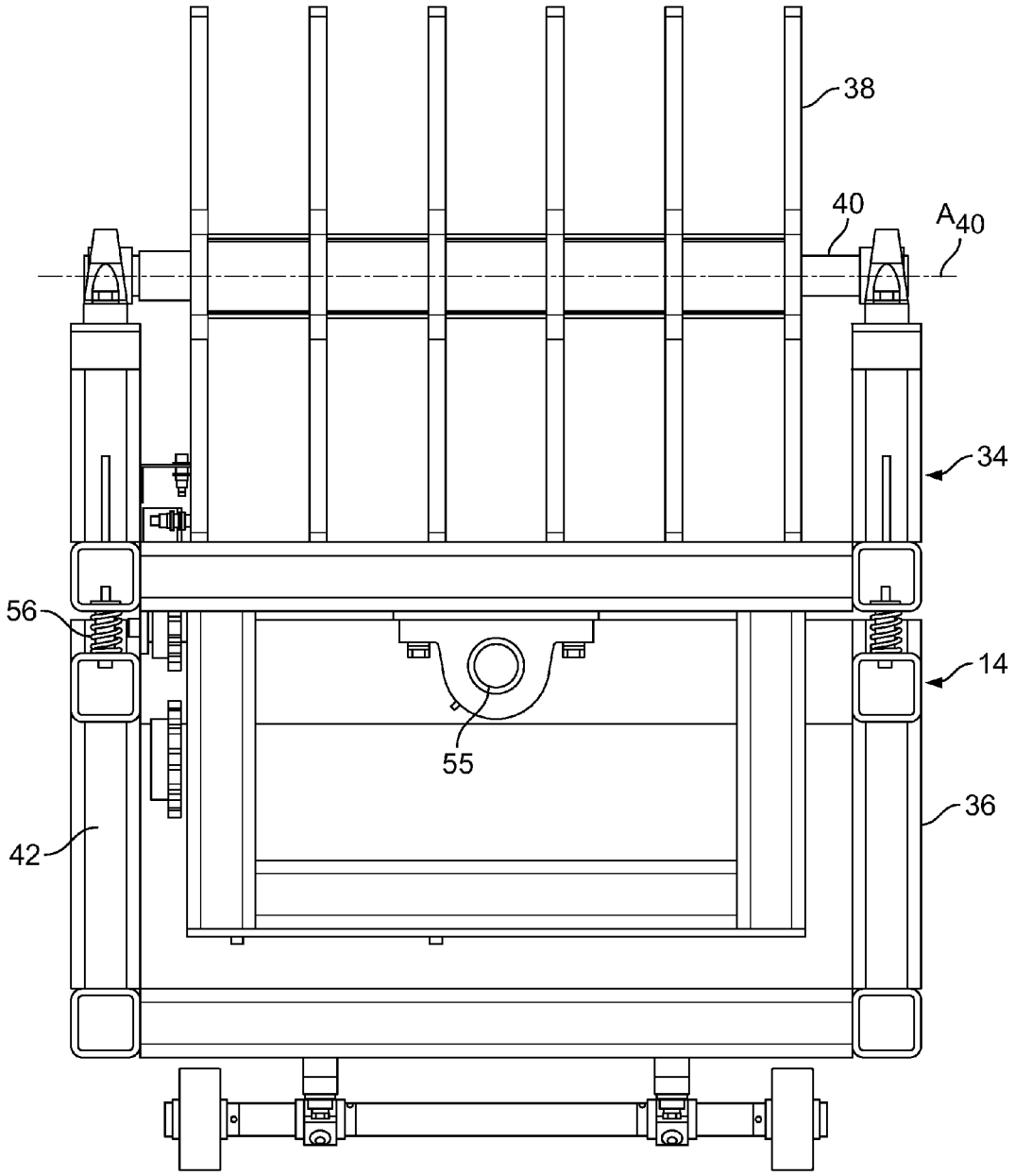
FIG. 5 is a side view of the conveyor load carriage and mobile base.
Figure 6:
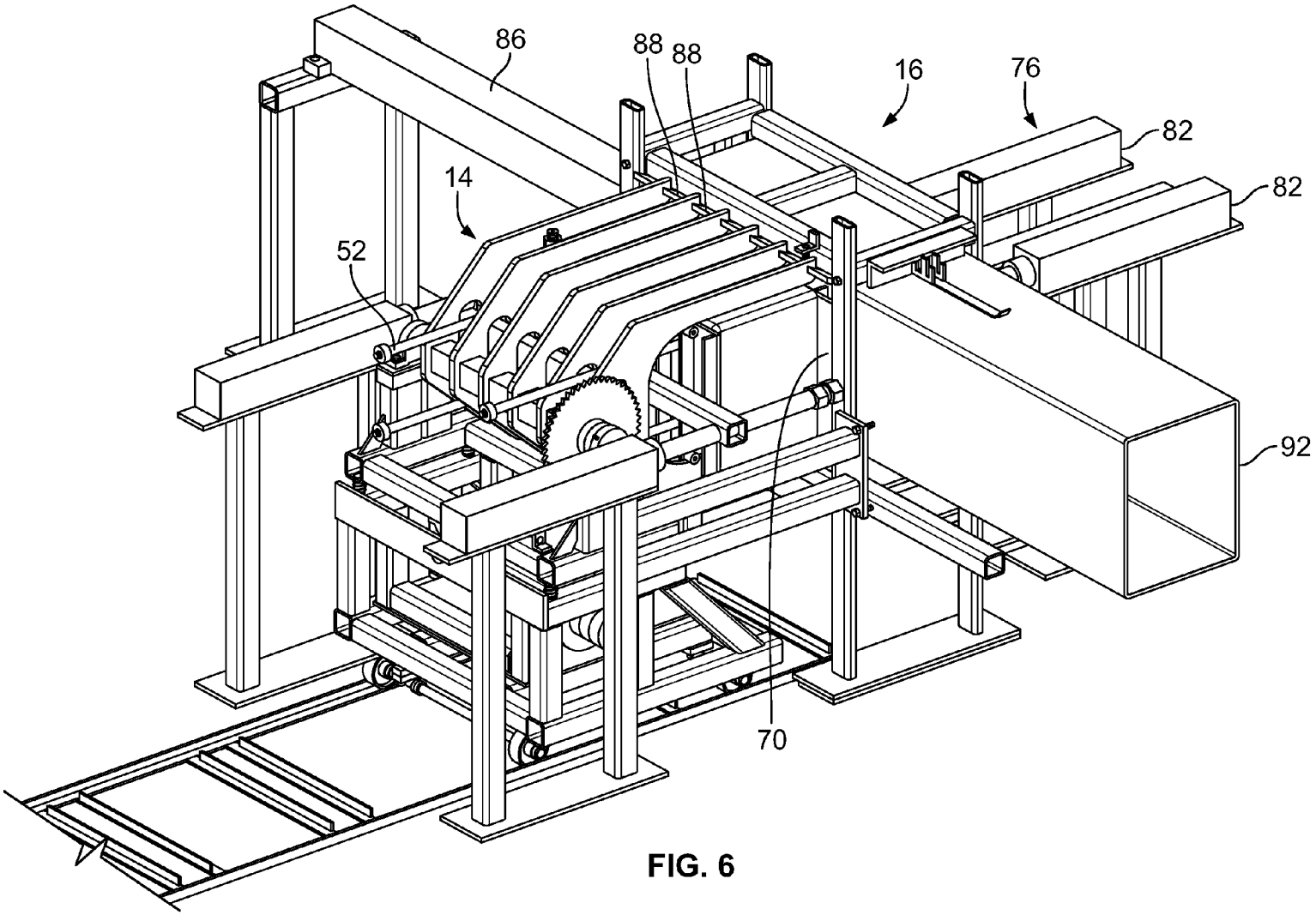
FIG. 6 is perspective view of the conveyor load carriage and mobile base in position to transfer a bale to the bagger.
Figure 8:
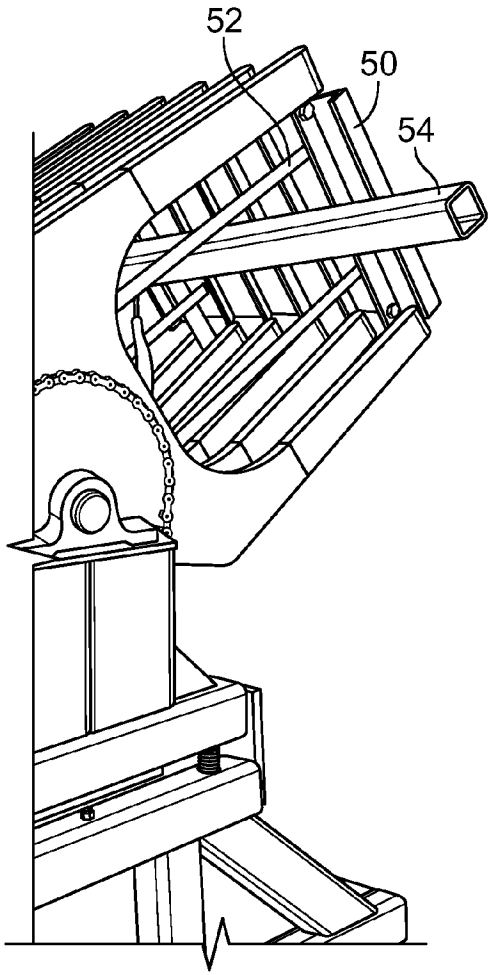
FIG. 8 is a photograph of the load carriage in a partially pivoted state.
Figure 7:
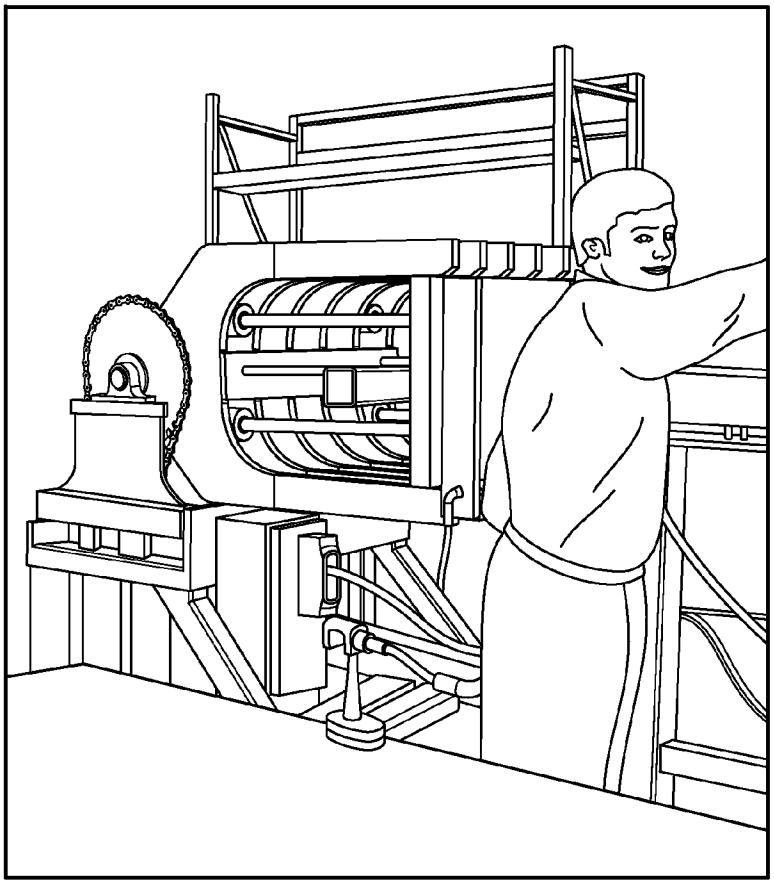
FIG. 7 is a photograph of the load carriage and base showing the transfer plate in an extended state.
Figure 10:
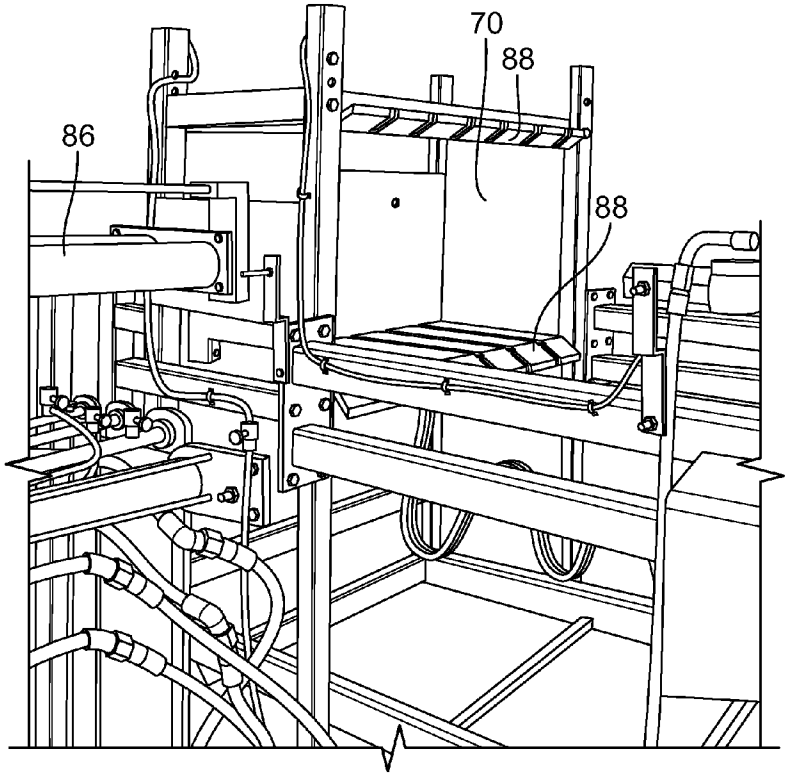
FIG. 10 is a photograph of the bagger entrance and showing, in partial view, the discharge drive.
Figure 9:
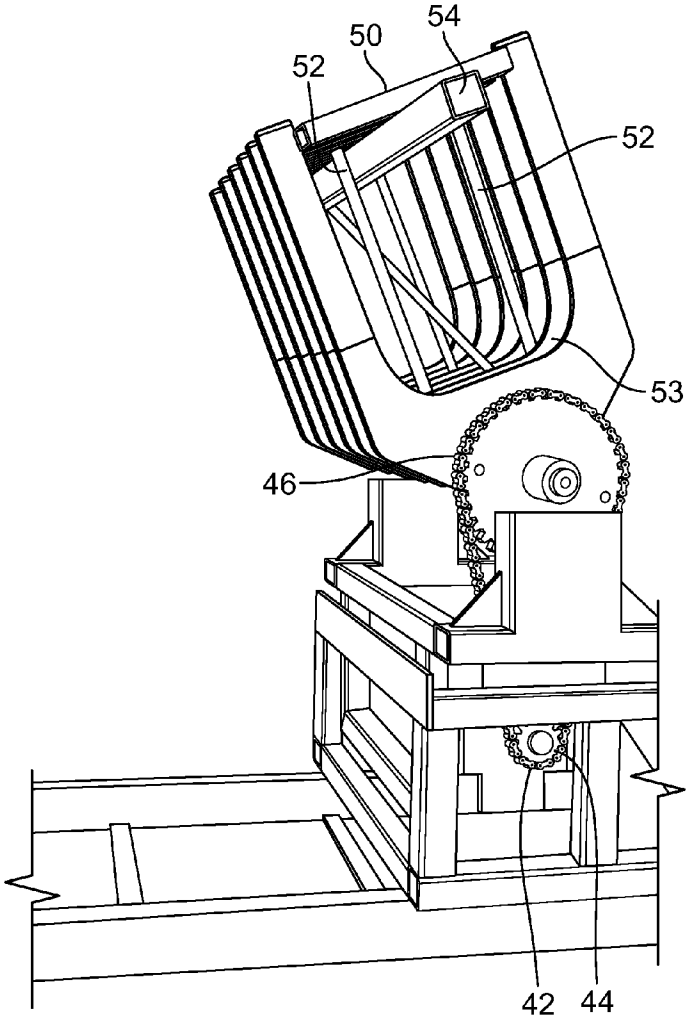
FIG. 9 is another photograph of the load carriage in a partially pivoted state.
Figure 12:
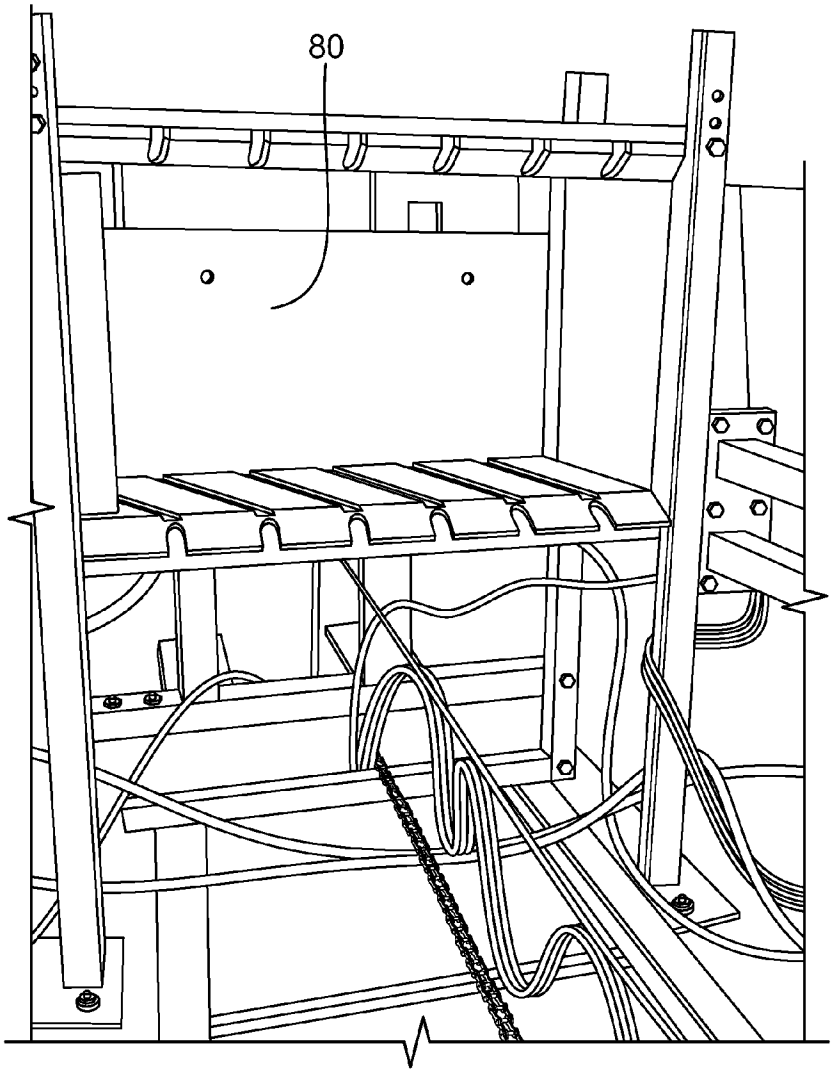
FIG. 12 is a photograph looking into the entrance of the bagger and showing the back-up plate.
Figure 11:
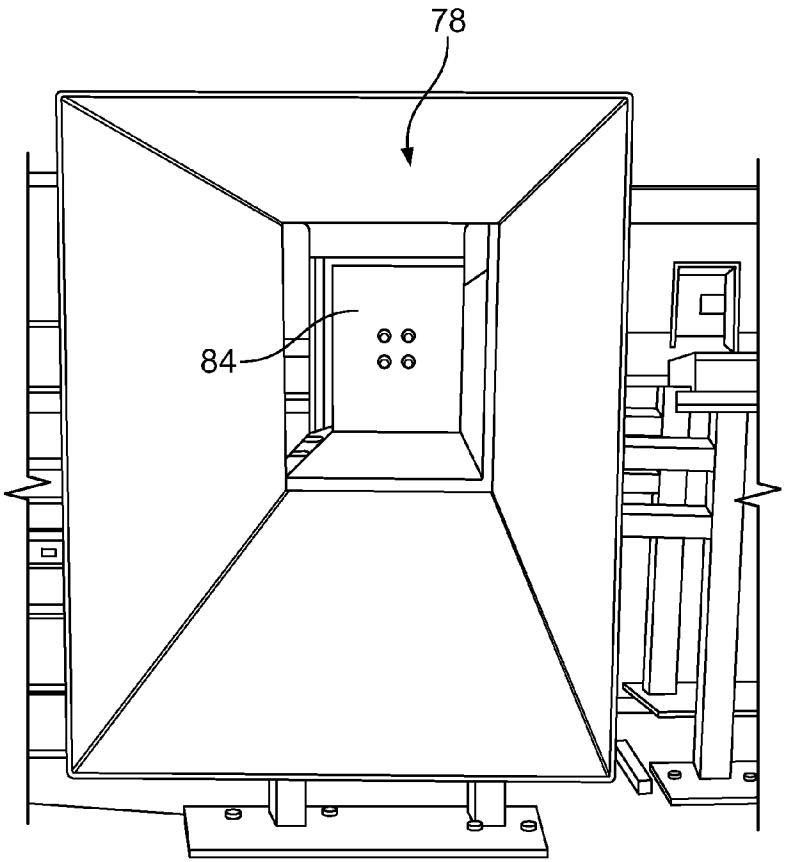
FIG. 11 is a photograph looking into the discharge end of the bagger and showing the discharge drive plate.
Figure 14:
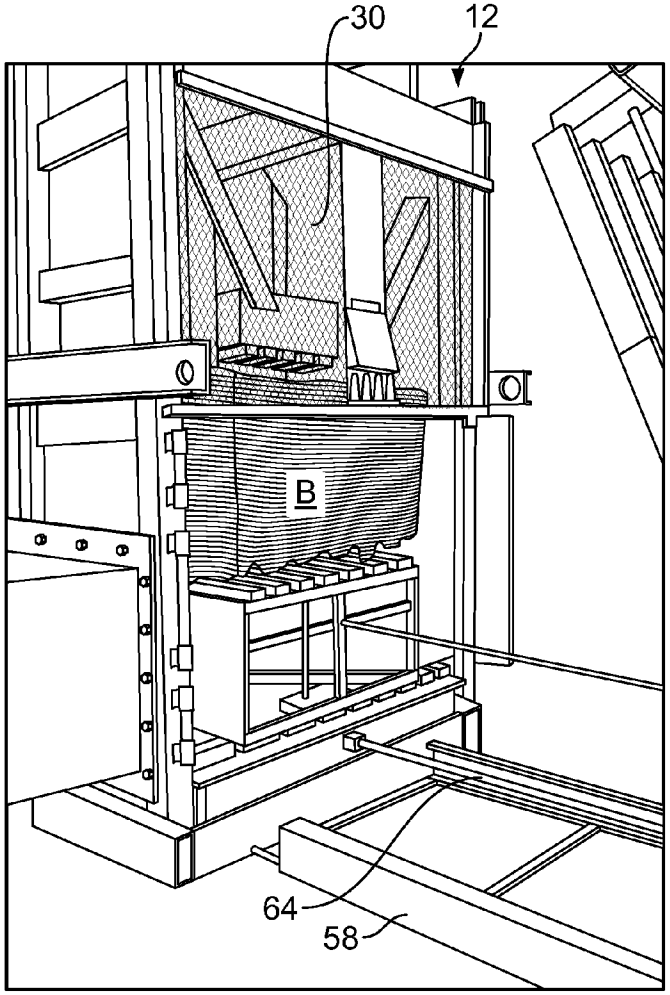
FIG. 14 is a photograph of the bale in the press.
Figure 13:
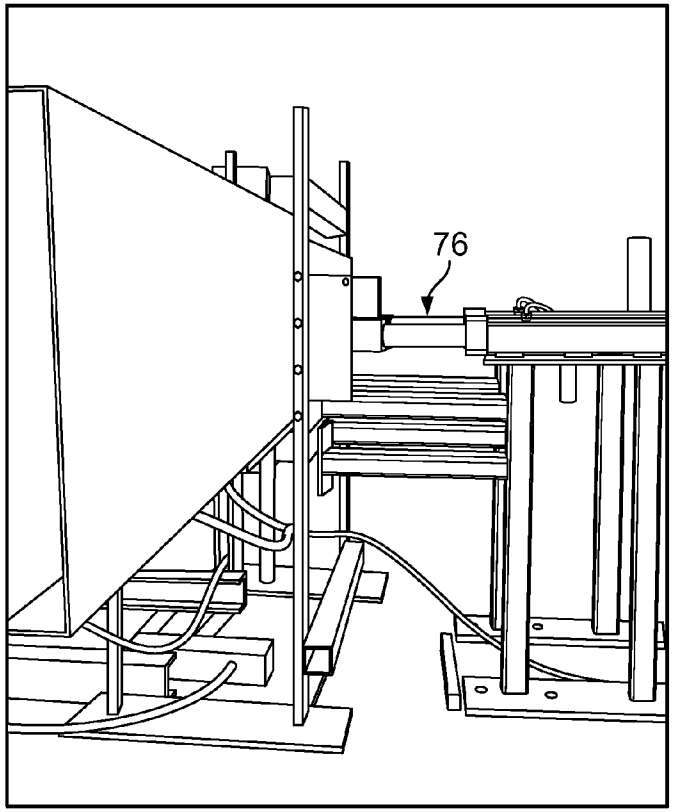
FIG. 13 is a photograph showing the side of the bagger and the back-up cylinders.

Referring now to the figures, and in particular to FIG. 1, there is shown an exemplary strap-less or wire-less baling machine 10 that can be used to carry out the present method. The baling machine 10 is used with a bale press 12 and includes, generally, a conveyor or cart 14, a bagger 16 and a control system or controller 18. For purposes of the present disclosure, the relative directions of side-to-side will refer to, for example, movement of the conveyor and/or cart 14 between the press 12 and bagger 16, and the directions of front-to-rear or rear-to-front will refer to, for example, movement of a bale B through the bagger 16.

The press 12 includes a receiver 20 having a lower compression platen 22 on which a compressible material, such as cotton, is received. An upper plate or follower block 24 is positioned above the receiver 20. The follower block 24 and platen 22 include a series of guides or channels 26 therein. The guides 26 are configured to receive the tines 28 of fork sets 38 that insert above and below the bale B. The press 12 is of a known design. Typically, such a press 12 includes gates 30 or other personnel protection features to prevent personnel access to the press 12 when in operation.

An embodiment of the conveyor 14 is formed as a cart 32. The cart 32 includes a load carriage 34 and a mobile base 36. The load carriage 34 includes multiple fork sets 38 mounted parallel to one another along a common shaft 40 that defines an axis $A_{40}$. The fork sets 38 pivot about 180 degrees about the axis $A_{40}$ as a single unit.

The fork sets 38 are spaced from one another a distance to cooperate with the guides 26 in the follower block 24 and platen 22. That is, the forks sets 38 insert into the guides 26 to, as will be described below, provide upper and lower supports as the bale B is removed from the press 12.

A drive assembly 42 is operably connected to the fork sets 38 to rotate the fork sets 38 about the axis $A_{40}$. The drive assembly 42 includes a drive 44, such as a motor, which can drive the fork sets 38 though a chain drive 46 mounted to the shaft 40, as illustrated, a gear drive or the like. Bearings 48 mounted at the ends of the shaft 40 provide for smooth movement of the shaft 40 and fork sets 38. The fork sets 38 are mounted to rotate or pivot about the $A_{40}$ axis about 180 degrees to reorient the bale B.

A pusher or transfer plate 50 is mounted to the fork sets 38 and defines a base or back wall for the fork sets 38. The transfer plate 50 is configured to push a bale B that is positioned in the fork sets 38 out of the fork sets 38. Shafts 52, mounted to plate 50, are mounted for sliding engagement with linear bearings 53, which are mounted to the fork sets 38. This provides smooth, linear movement of the plate 50 and assures that the plate 50 remains transverse to the fork sets 38 (that is, the plate 50 and bale B remain straight) as the bale B is transferred from the fork sets 38.

A support bar 54 is also mounted to the plate 50. In an embodiment, the support bar 54 is mounted to a rear side of the plate 50. The support bar 54 can be centrally disposed on the plate 50. Although a single bar is shown, it will be appreciated that multiple bars can be used.

The load carriage 34 is mounted to the cart 14 by a pivot shaft 55. A plurality of springs 56 extend between the load carriage 34 and the cart 14. The pivot shaft 55 allows the load carriage 34 to pivot a short distance side-to-side relative to the cart 14. The springs 56 maintain the load carriage 34 in a relatively fixed relationship to the cart 14, but allow the load carriage 34 to pivot slightly to adjust any shifting of the bale B within the press 12 and any shifting of the follower block 24 or platen 22 that may occur. It will be appreciated that because of the extreme force (up to one million pounds) that is exerted on the bale B, the follower block 24 and/or platen 22 may shift slightly. As such, the springs 56 are relatively short and are positioned at about the corners of the load carriage 34, as the load carriage 34 resides on the cart 14. In this manner, the load carriage 34 can pivot a small amount about the pivot shaft 55 to self-adjust to accommodate any shifting of the bale B and/or follower block 24 and platen 22 so that the fork sets 38 properly insert into the guides 26, but cannot skew to any extent.

The cart 14 is mounted to a track 58 along which the cart 14 is conveyed between the press 12 and the bagger 16. It will be appreciated by those skilled in the art that the track 58 can be as long or as short as necessary to accommodate the footprint in which the system (including the press 12, conveyor/cart system 14 and bagger 16) is located. There are minimum space requirements, insofar as removing or withdrawing the bale B from the press 12 and rotating the load carriage 34 and bale B for introduction to the bagger 16.

The cart 14 can be driven along the track 58 in any of a number of ways. For example, a drive 60, including a motor 62 and chain drive 64 as illustrated, a friction drive or the like can be used to move the cart 14 between the press 12 and the bagger 16.

A transfer station 66 is formed as part of the conveyor. In a present embodiment, the transfer station 66 includes a drive, such as the illustrated pair of cylinders 68 mounted upstream of the bagger 16. The cylinders 68 cooperate with the transfer plate 50 and support bar 54 to ensure proper transfer of the bale B from the load carriage 34 to the bagger 16.

The bagger 16 includes an entrance 70, a discharge station 72, a bag mandrel 74 and may include a back-up assembly 76. The discharge station 72 includes a chute 78 into which the bale B is transferred from the load carriage 34. As such, the entrance 70 opens into a chute 78—the entrance 70 is that side facing the cart load carriage 34—to receive the bale B. The back-up assembly 76, if used, is positioned on a side opposite the entrance 70 and includes a movable wall 80 mounted to the chute 78 by a drive 82, for example, the illustrated plurality of cylinders. The wall 80 moves from the side of the chute 78 to the bale B as the bale B enters the entrance 70, to facilitate transfer of the bale B into the chute 78.

A discharge plate 84 is mounted at a rear of the discharge station 72, rearward of the entrance 70. The discharge plate 84 is driven forwardly into the chute 78 by a drive 86, for example, a cylinder. In a home position, the discharge plate 84 is rearward of the entrance 70 so as to not interfere with movement of the bale B into the chute 78. The cylinder or drive 86 for the discharge plate is a dual-acting drive so that the plate 84 can be returned to the home position following discharge of the bale B. The entrance 70 includes guides 88 that cooperate with the fork sets 38 when transferring a bale B from the load carriage 34 to the bagger 16.

The bag mandrel 74 is positioned at the front of the discharge station 72. A bag, having a sealed end, is positioned over the end of the mandrel 74. In this manner, as the bale B is pushed out of the chute 78, it engages the bag and pulls the bag onto and over the bale B.

The controller 18 includes an operator interface station 94. The controller 18 controls the overall operation of the baler system 10. The controller 18 can also be integrated to include control of the press 12.

In a typical cycle, material is loaded into the press 12. When the compression or compaction cycle is complete, the gate 30 on the press 12 is opened.

The cart 14 is moved toward and into the press 12. The fork sets 38, which are in a horizontal orientation, are inserted into the press follower block 24 and platen 22 guides 26 above and below the bale B, respectively. As noted above, in the event that the bale B shifts or that the guides 26 are slightly askew, the pivot shaft 55 and spring 56 mounting of the load carriage 34 to the cart 14 allow the load carriage 34 to pivot slightly side-to-side to align with the guides 26. Moving the cart 14 inward toward, and into engagement with the bale B urges the transfer plate 50 into the apex of the fork sets 38.

Once the cart 14 is properly positioned with the bale B captured within fork sets 38, the fork sets drive 44 can be actuated to rotate the fork sets 38 and the bale B upward at a slight angle to facilitate loosening the bale B from the press 12. Once the bale B is free of the press 12, the cart 14 backs away from the press 12 and begins to move toward the bagger 16. At this time, the fork sets 38 and bale B are pointed generally in the direction of the press 12.

The drive 44 is then actuated to rotate the fork sets 38 about 180 degrees. The fork sets 38 can be rotated as the cart 14 is stopped or as the cart 14 is moving toward the bagger 16. In the final orientation, the fork sets 38 and the bale B are reoriented to point toward the bagger 16 with the bale B at about the entrance 70 of the chute 78. In this position, the fork sets 38 are located between the transfer cylinders 68 and the entrance 70, and the support bar 54 is aligned (horizontally) with the transfer cylinders 68.

To accept the bale B, the back-up assembly 76, if used, is extended toward the entrance 70, and the discharge plate 84 is in a retracted or home position. The cart 14 is moved toward the bagger 16 so that the fork sets 38 align and cooperate with the entrance guides 88, and the cart is further moved forward to move the bale B into the entrance 70. When the bale is at the entrance 70, the back-up assembly wall 80 is in contact with the side of the bale B at the entrance. In this manner, the bale B is captured between the transfer plate 50 and the wall 80. The back-up assembly 76, which as noted above may be used, can be used if, for example, there is more fiber on one side of the bale B than on the other side of the bale B. Thus, when the bale B is captured between the transfer plate 50 and the back-up assembly 76, the back-up assembly 76 supports bale B transfer from the fork sets 38 and also prevents loosening of the bale (e.g., the bale B is retained in the compressed state).

The transfer cylinders 68 are then actuated which pushes the transfer plate 50, which in turn pushes the bale B in a transfer direction from the fork sets 38 into the entrance 70. It will be appreciated that the shafts 52 maintain the plate 50 flat against the side of the bale B, and do not allow the plate to skew, as the bale B is pushed into the entrance 70. Pushing the bale B into the entrance 70 also pushes the wall 80 back to a retracted position.

Once the bale B is in the chute 78, the discharge plate cylinder 86 is actuated to push the bale B from the entrance 70 along or through the chute 78 toward the bag mandrel 74 in a bagging or containerizing direction. The bagging direction is transverse to the transfer direction.

It is contemplated that a bale B will be present in the discharge end 90 of the chute 78 as a subsequent bale is introduced into the entrance 70. As the bale B in entrance 70 is urged toward the discharge end 90, the prior bale (in the discharge end 90) is forced out through the mandrel 74 and captures a bag at the final discharge 92.

As noted above, essentially, the present baling method permits compressing and containing, and optionally protecting, a compressible material such as a cotton bale, without the need for straps, wires or the like around the bale. In one sense, the method includes compressing a quantity of a compressible material, such as cotton, into a bale, and introducing the compressed material into a package, such as a bag.

The bag can include strengthening or stabilizing members, such as straps or stiffeners internally, externally or formed as part of the bag (e.g., molded with the bag) to provide stability to the compressed and packaged bale. The bag can then be closed or sealed to form a packaged bale for subsequent handling.

The bale can be compressed into a predetermined shape, generally, so as to fit within a bag having the same general shape.

It will be appreciated that the present strap-less or wireless baler provides a number of advantages over known baling systems. Foremost, the present system allows for high pressure compaction of compressible material, conveyance and packaging (e.g., bagging), without the need for strapping the bale. Additionally, the present system, allows for high pressure compaction and conveyance using a transfer device, e.g., cart 14 and load carriage 34 that permit positively engaging and supporting a bale even if the bale and/or press have shifted slightly, without losing the effectiveness of the compaction cycle, e.g., loosening of the compacted bale B.

Although the various drives are described as motors, chain drives, cylinders and the like, it is to be understood that any type of suitable drive other than those described can be used in most if not all of the disclosed assemblies and that all such drives fall within the scope of the present disclosure.

It will also be appreciated by those skilled in the art that the relative directional terms such as sides, upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A strap-less baler for use with a press for compressible materials, comprising:

a frame;

a conveyor, the conveyor including a mobile portion and a load carriage, the load carriage movably mounted to the mobile portion and including a region for receiving a bale from the press; and a bagger, the bagger including a chute having an entrance and a discharge, the discharge having a bagging mandrel, the bagger configured to receive a bale and move the bale from the entrance to the discharge and the bagging mandrel, wherein the load carriage is configured to receive the bale in an orientation and reorient the bale about 180 degrees to transfer the bale to the bagger entrance, and wherein the bale is introduced into the bagger without straps or wires on the bale.

2. The strap-less baler of claim 1 wherein the load carriage includes a plurality of fork sets mounted for rotation about a common axis, the fork sets rotating to reorient the bale.

3. The strap-less baler of claim 2 wherein the load carriage is pivotally mounted to the mobile portion.

4. The strap-less baler of claim 3 including a pivot axis about which the load carriage is pivotally mounted to the mobile portion.

5. The strap-less baler of claim 4 including springs extending between the load carriage and the mobile portion.

6. The strap-less baler of claim 1 including a pusher mounted within the fork sets to facilitate pushing the bale from the fork sets.

7. The strap-less baler of claim 6 wherein the pusher is a transfer plate.

8. The strap-less baler of claim 1 including a transfer station to facilitate transfer of the bale from the load carriage to the bagger.

9. The strap-less baler of claim 8 including a support element mounted to the pusher and a transfer drive cooperating with the support element to facilitate transfer of the bale to the bagger.

10. The strap-less baler of claim 9 wherein the transfer drive is a reciprocating cylinder.

11. The strap-less baler of claim 1 wherein the bagger entrance is located on a side of the bagger and including a discharge transverse to the entrance.

12. The strap-less baler of claim 11 including a bag mandrel at the bagger discharge.

13. The strap-less baler of claim 1 wherein the conveyor includes a track for moving the mobile portion and load carriage between the press and the bagger.

14. The strap-less baler of claim 2 wherein the bagger entrance includes guides configured to cooperate with the fork sets for transferring the bale from the load carriage to the bagger.

15. The strap-less baler of claim 1 including a controller.

* * * * *